US008496494B2

(12) United States Patent
Jordan

(10) Patent No.: US 8,496,494 B2
(45) Date of Patent: Jul. 30, 2013

(54) ELECTRICAL CONNECTOR

(75) Inventor: Peter Jordan, Basingstoke (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 344 days.

(21) Appl. No.: 13/028,132

(22) Filed: Feb. 15, 2011

(65) Prior Publication Data

US 2011/0207360 A1 Aug. 25, 2011

(30) Foreign Application Priority Data

Feb. 22, 2010 (GB) ..... 1002972.6

(51) Int. Cl.
*H01R 13/627* (2006.01)

(52) U.S. Cl.
USPC ..... 439/349; 439/680; 439/902

(58) Field of Classification Search
USPC ..... 439/349, 680, 902
See application file for complete search history.

(56) References Cited

U.S. PATENT DOCUMENTS

| | | | | | |
|---|---|---|---|---|---|
| 2,000,318 | A | * | 5/1935 | Cannon | 439/354 |
| 2,374,971 | A | * | 5/1945 | Benander | 174/59 |
| 2,677,811 | A | * | 5/1954 | Anderson et al. | 439/349 |
| 2,761,111 | A | * | 8/1956 | Klostermann | 439/271 |
| 2,916,720 | A | * | 12/1959 | Steans | 439/370 |
| 2,933,711 | A | | 4/1960 | Eaton | |
| 3,237,147 | A | * | 2/1966 | Elliott et al. | 439/348 |
| 3,352,576 | A | * | 11/1967 | Thorne-Thomsen | 285/148.2 |
| 3,848,949 | A | * | 11/1974 | Falkner | 439/426 |
| 3,962,692 | A | | 6/1976 | Murphy et al. | |
| 4,186,983 | A | * | 2/1980 | Kaye | 439/350 |
| 4,364,624 | A | * | 12/1982 | Williams | 439/651 |
| 4,708,663 | A | * | 11/1987 | Eckart | 439/469 |
| 4,711,510 | A | * | 12/1987 | Orlando, Jr. | 439/246 |
| 4,929,188 | A | * | 5/1990 | Lionetto et al. | 439/349 |
| 5,195,904 | A | * | 3/1993 | Cyvoct | 439/349 |
| 5,288,242 | A | * | 2/1994 | Muzslay | 439/349 |
| 5,743,754 | A | | 4/1998 | Cristich | |
| 5,911,595 | A | * | 6/1999 | Orr et al. | 439/471 |
| 5,938,465 | A | * | 8/1999 | Fox, Sr. | 439/350 |
| 6,224,421 | B1 | * | 5/2001 | Maturo, Jr. | 439/581 |
| 6,332,815 | B1 | * | 12/2001 | Bruce | 439/862 |
| 6,709,289 | B2 | * | 3/2004 | Huber et al. | 439/578 |
| 6,966,781 | B1 | * | 11/2005 | Bullinger et al. | 439/38 |
| 7,274,964 | B2 | * | 9/2007 | Balsells | 607/37 |
| 7,597,588 | B1 | * | 10/2009 | Hyzin et al. | 439/578 |
| 7,632,121 | B2 | * | 12/2009 | Gonzales et al. | 439/188 |
| 8,100,707 | B2 | * | 1/2012 | Kussel et al. | 439/271 |
| 8,375,543 | B1 | * | 2/2013 | Balsells | 29/227 |

FOREIGN PATENT DOCUMENTS

| | | | |
|---|---|---|---|
| DE | 42 10 491 | A1 | 10/1993 |
| DE | 10 2006 006 845 | B3 | 7/2007 |
| EP | 0 050 575 | A1 | 4/1982 |
| EP | 0 579 551 | A1 | 1/1994 |
| EP | 1 819 019 | A1 | 8/2007 |
| GB | 2083296 | A | 3/1982 |

* cited by examiner

*Primary Examiner* — Neil Abrams
(74) *Attorney, Agent, or Firm* — Leon D. Rosen

(57) ABSTRACT

A first electrical connector (1) for terminating an electrical cable (11) and for engaging with a mating electrical connector (51). The first connector comprises a body (5) having an engagement portion including a sleeve (7) whose passage extends along a mating axis (101) for engaging the mating electrical connector. The connector comprises at least one resilient member (15), such as a coil spring, arranged on the sleeve. The resilient member is capable of deforming radial to the mating axis (101) to provide a reaction force for maintaining the engagement of the connector with the mating connector. The first connector can be detached by lifting a boot (13) to pry apart the connectors.

1 Claim, 4 Drawing Sheets

ELECTRICAL CONNECTOR

CROSS-REFERENCE

Applicant claims priority from Great Britain patent application GB1002972.6 filed Feb. 22, 2010.

FIELD OF THE INVENTION

This invention relates to an electrical connector for terminating an electrical cable, such as a shielded cable. In particular, the invention relates to a so-called "breakaway" connector, which can be firmly engaged with a mating connector but can be quickly and easily disengaged when required.

BACKGROUND OF THE INVENTION

U.S. Pat. No. 2,761,111 discloses a known breakaway electrical connector for terminating an electrical cable. The electrical connector is arranged to be mechanically engageable with a mating electrical connector to provide an electrically conductive path from the electrical cable to the mating connector. The connectors can be firmly engaged but quickly and easily disengaged when required.

The mating electrical connector described in the U.S. patent is a female connector having a receptacle within which is formed an annular groove. An endless coil spring is retained within the annular groove and partially protrudes therefrom. A plurality of elongate contacts is also arranged within the receptacle and maintained in a parallel longitudinal configuration by a dielectric spacing element.

The cable-terminating connector described in the U.S. patent is a male connector in the form of a plug. A rearward end of the plug is provided with an opening for routing the cable away from the connector in a longitudinal direction. A forward end portion of the plug is provided with an annular groove which is shaped and dimensioned to receive the protruding part of the endless coil spring when the plug and the receptacle of the mating connector are engaged. A plurality of elongate sprung contacts is also arranged within the plug and maintained in a parallel longitudinal configuration by a dielectric spacing element.

The forward tip of the plug is tapered to exert a cam action, whereby an inward thrust of the plug into the receptacle of the mating connector will expand the coil spring to enable the spring to snap into the annular groove formed in the plug, and thus maintain the engagement of the connectors. In this way the sprung contacts of the plug may be held in firm pressure engagement with the fixed contacts of the receptacle to provide the electrically conductive path. The connectors are disengaged by exerting a longitudinal or transverse force on the plug or the cable to thereby expand the coil spring to enable the spring to snap out of the annular groove formed in the plug.

A problem associated with the known breakaway connector arrangement disclosed in U.S. Pat. No. 2,761,111 is that tension on the electrical cable can lead to accidental disengagement of the connector. Furthermore, tension applied on the cable for deliberately disengaging the connectors may cause excessive stress on the connections and lead to damage. The connector arrangement disclosed in the U.S. patent is of limited utility since there is no provision for electrical shielding of the connections.

Embodiments of the invention may address these and/or other technical problems.

SUMMARY OF THE INVENTION

According to an aspect of the invention there is provided an angled electrical connector for terminating an electrical cable and for engaging with a mating electrical connector, the angled connector comprising:

a body having an engagement portion including a sleeve which extends in a longitudinal first direction for engaging with the mating electrical connector, the body further having an opening for routing conductors of the cable away from the connector; and at least one resilient member arranged on the sleeve of the engagement portion, the resilient member being capable of deforming in a transverse direction perpendicular to the first direction and providing a reaction force for maintaining the engagement of the connector with the mating connector, wherein the opening of the body for routing the conductors of the cable away from the connector is arranged to route the cable in a second direction substantially perpendicular to the first direction.

The invention thus provides an electrical connector for terminating an electrical cable in which tension on the cable is less likely to lead to accidental disengagement with a mating electrical connector. In particular, the tension on the cable is in a direction which is substantially perpendicular to the direction of a force required for disengaging the connectors. Furthermore, when the mating connector is mounted in a panel, the connectors may be conveniently disengaged by inserting a user's hand between the panel and the cable to pivoting the cable away from the panel.

The at least one resilient member may comprise a coil spring extending about the sleeve of the engagement portion. The coil spring may be an endless coil spring which defines a closed loop.

The coil spring may have a canted arrangement whereby the coils of the spring are canted with respect to a centerline of the coil spring. In such an arrangement the coils of the coil spring each define an acute angle with a respective plane normal to the centerline of the spring. Such springs may have an annular shape with a cross section which is typically elliptical. In use of the canted coil spring, compression in the transverse direction causes increased canting of the coils of the spring, together with a reaction force which acts in the transverse direction. Compared to a normal coil spring, the compression and reaction force provided by a canted coils spring may be more progressive (i.e. increase gradually).

The coil spring may be arranged in and retained by a groove or channel formed in the sleeve of the engagement portion such that portions of the coils of the coil spring protrude out of the groove or channel. In embodiments which are female connectors the groove or channel is generally formed on the inner surface of the sleeve, but in other embodiments (for example where the connector is a male connector) the groove or channel may instead be formed on the outer surface of the sleeve. When the coil spring has a canted arrangement it may be in contact with a bottom surface of the groove or channel.

In preferred embodiments of the invention the sleeve of the engagement portion has a circular cross-section. In this case, references to the transverse direction refer collectively to radial directions, and the at least one resilient member is arranged about the circumference of the sleeve.

In preferred embodiments of the invention the body further has a collar portion which extends in the second direction and defines the opening for routing the conductors of the cable away from the connector. The collar portion provides an elongate opening extending in the second direction for routing the conductors. An outer surface of the collar portion may define a crimp barrel for receiving an outer conductor, or braid, of a shielded cable and over which a ferrule may be crimped in a conventional manner which will be well understood by the skilled person. The collar portion may be provided with a protective boot or plastic overmoulding for protection and strain relief.

The body, and more particularly the sleeve, of the engagement portion may further have a flange extending in the transverse direction and defining an abutment surface which may be parallel to the first direction for abutting a corresponding surface of the mating connector when the connectors are in a fully engaged configuration (only). When the electrical cable is then pulled in the second direction the contact between the abutment surfaces resists transverse displacement of the angled connector relative to the mating connector, which displacement might otherwise cause misalignment of the electrical contacts and/or accidental disengagement of the connectors. When the angled connector is a female connector the flange may extend inwardly from the sleeve of the engagement portion and the abutment surface may be an inwardly-facing surface.

The body may also define a frustro-conical surface for longitudinally and transversely locating the connector with respect to the mating connector as the connectors are engaged. The frustro-conical surface may be arranged to cooperate with a corresponding frustro-conical surface on the mating connector.

Embodiments of the invention may further comprise: a dielectric spacing element arranged within the sleeve of the engagement portion and provided with a number of through holes extending in the first direction; and a number of elongate conductive contacts arranged in respective through holes of the spacing element for providing electrical connections.

The invention also provides a shielded electrical connector comprising the angled electrical connector described hereinabove. In these embodiments the body and resilient member may be formed of, or plated with, metallic materials for providing an electrically conductive path from the electrical cable to the mating electrical connector. Embodiments in which the resilient member is a metallic coil spring have been found to provide a particularly reliable electrical connection between the body of the connector and a body of the mating connector.

The invention also provides an electrical connector pair comprising:

a first electrical connector in the form of the angled connector described hereinabove; and a second electrical connector mated to the first electrical connector, the second connector comprising a body having an engagement portion which includes a sleeve, the sleeve extending in the first direction and being engaged with the sleeve of the first connector.

The sleeve of the second connector may define a cam surface which bears against the at least one resilient member when the connectors are engaged with each other to thereby retain the connectors in the mated configuration. The body of the second connector may have a mounting flange for mounting the connector to a panel.

According to another aspect of the invention there is provided an electrical connector pair comprising:

a first electrical connector for terminating an electrical cable and for engaging with a mating electrical connector, the first connector comprising a body having an engagement portion including a sleeve which extends in a longitudinal first direction for engaging with the mating electrical connector, the body further having an opening for routing conductors of the cable away from the connector; and a second electrical connector mated to the first electrical connector, the second connector comprising a body having an engagement portion which includes a sleeve, the sleeve extending in the first direction and being engaged with the sleeve of the first connector, wherein the second connector further comprises at least one resilient member arranged on the sleeve of the engagement portion, the resilient member being capable of deforming in a transverse direction perpendicular to the first direction and providing a reaction force for maintaining the engagement of the second connector with the first connector, and wherein the opening of the body for routing the conductors of the cable away from the connector is arranged to route the cable in a second direction which is substantially perpendicular to the first direction.

This aspect of the invention corresponds to the first aspect described herein above, except that the at least one resilient member is carried by the sleeve of the second connector instead of the first, angled connector.

The sleeve of the first connector may then define a cam surface which bears against the at least one resilient member when the connectors are engaged with each other to thereby retain the connectors in the mated configuration. The body of the second connector may have a mounting flange for mounting the connector to a panel.

Other features and advantages of the invention will become apparent from the detailed description of the invention provided hereinbelow.

The invention will be better understood from a reading of the following description which is given purely by way of example with reference to the drawings.

BRIEF DESCRIPTION OF THE DRAWINGS

An exemplary embodiment of the invention will now be described in detail with reference to the accompanying drawings, in which.

DESCRIPTION OF THE PREFERRED EMBODIMENTS

The invention provides an angled electrical connector for terminating an electrical cable and for engaging with a mating electrical connector. The angled connector 1 comprises a body 5 having an engagement portion including a sleeve with a sleeve passage which extends in a longitudinal first direction for engaging with the mating electrical connector, the body further having an opening for routing conductors of the cable away from the connector. The connector also comprises at least one resilient member 15 arranged on the sleeve of the engagement portion, the resilient member being capable of deforming in a transverse direction perpendicular to the first direction and providing a reaction force for maintaining the engagement of the connector 1 with the mating connector 51. According to the invention, the opening of the body for routing the conductors of the cable away from the connector is arranged to route the cable in a second direction, which is substantially perpendicular to the first direction, for example in the range 60° to 120°, and preferably in the range 75° to 105°.

The invention also provides an angled electrical connector similar to that described hereinabove, but without the at least one resilient member. In this case, the resilient member is instead provided on a sleeve of a body of the mating electrical connector.

Figure 1A:
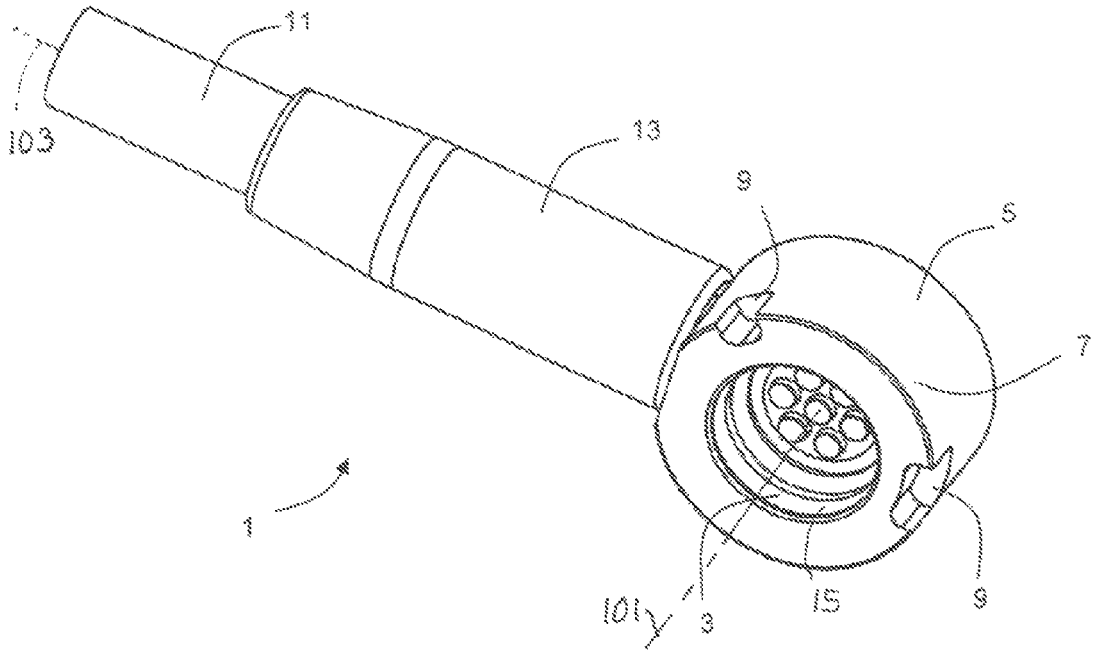
FIG. 1*a* is a perspective view of an angled electrical connector according to the invention.

FIG. 1*a* shows the underside of an angled electrical connector 1 according to the invention. The angled connector 1 is a female connector having a receptacle 3 for receiving a male connector (not shown in FIG. 1*a*). A plurality of elongate electrical contacts is arranged within the receptacle 3, as will be described in more detail hereinbelow.

The angled connector 1 comprises a metallic outer body 5 formed, for example, of nickel-plated stainless steel. The body 5 has an engagement portion including a circular sleeve 7 for engaging the male connector. The sleeve 7 has a generally cylindrical outer shape and its sleeve passage extends along axis 101 in a longitudinal first direction. An outer surface of the sleeve 7 is provided with notches 9 which align with corresponding features of the male connector to ensure correct circumferential alignment when the connectors are brought into engagement. An inner surface of the sleeve 7 has a circular cross section and is provided with engagement means for mechanically coupling the connectors, as will be described in more detail hereinbelow.

The connector body 5 also has a collar portion (37, FIG. 3) extending in a second direction which is perpendicular to the first direction. The collar portion defines an elongate opening for routing the inner conductors of a terminated cable 11 in direction 103 away from the connector 1. The collar portion is hidden from view in FIG. 1 since it is covered by a protective rubber boot 13 of a tube 108.

Figure 1B:
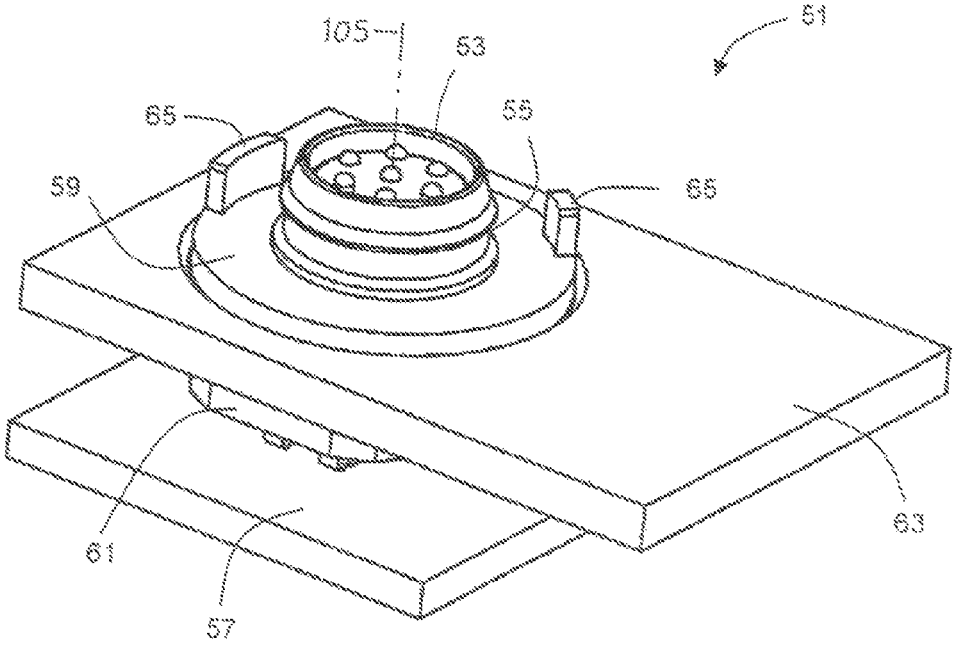
FIG. 1*b* is a perspective view of an electrical connector for mating with the angled connector shown in FIG. 1.

FIG. 1*b* shows a mating electrical connector 51 intended for mating with the angled connector 1 shown in FIG. 1*a*. The mating connector 51 is a male connector comprising an outer body 53 formed, for example, of nickel-plated stainless steel. The body 53 of the mating connector 51 has an engagement portion including a longitudinally-extending sleeve 55 extending along axis 105 for engaging the angled first connector 1. A plurality of elongate electrical contacts is arranged within the sleeve 55 for connection to the tracks of a printed circuit board 57, as will be described in more detail hereinbelow. An outer surface of the sleeve 55 is provided with engagement means for mechanically coupling the connectors 1, 51, as will be described in more detail hereinbelow.

The mating connector sleeve 55 also has an annular mounting flange 59, a threaded section (not shown in FIG. 1*b*) adjacent to the mounting flange 59, and a lock nut 61 for mounting the connector 51 to an equipment panel 63, which panel does not itself form a part of the mating connector 51. The mounting flange 59 is provided with longitudinally-extending posts 65 which align with the notches 9 formed in the angled connector 1 to ensure correct circumferential alignment when the connectors 1, 51 are brought into engagement.

Figure 2:
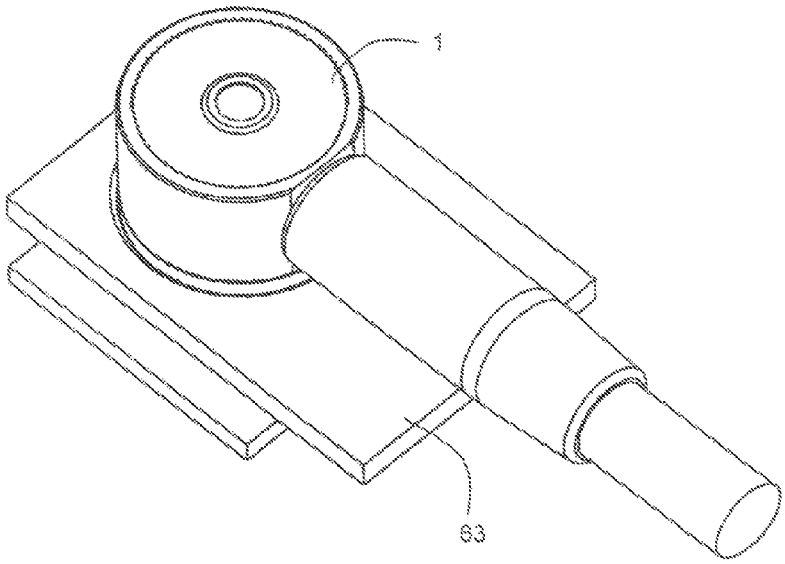
FIG. 2 is a perspective view of the connectors shown in FIGS. 1*a* and 1*b* in the mated configuration.

FIG. 2 is a perspective view of the connectors 1, 51 shown in FIGS. 1*a* and 1*b* in the mated configuration. As will be seen, in the mated configuration, the angled connector 1 entirely covers the portion of the mating connector 51 which is exposed above the equipment panel 63 in which it is mounted.

Figure 3:
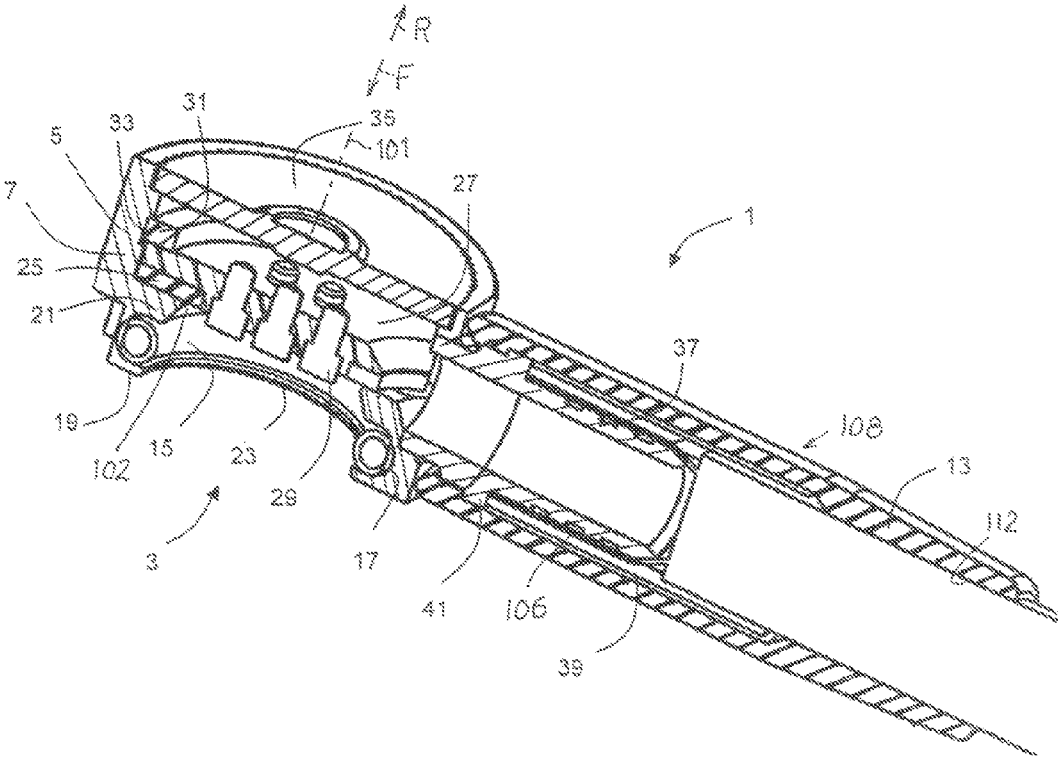
FIG. 3 is a cut-away perspective view showing the connector of FIG. 1*a* in more detail.

FIG. 3 shows the angled first connector 1 shown in FIG. 1 a in greater detail. The Figure shows the connector body 5 and the protective rubber boot 13 described hereinabove, together with other features of the connector 1. The connector 1 comprises a resilient member in the form of an endless coil spring 15 that extends in a circle about the axis 101. The coil spring 15 is arranged in and retained by an annular groove 17 formed in the inner surface of the sleeve 7 of the outer body 5. A portion of each coil of the coil spring 15 protrudes radially inward from the annular groove, as illustrated. The coil spring 15 has a canted arrangement whereby the coils of the spring are canted with respect to a centerline of the coil spring 15. That is, the spring has a turn that extends about an axis that is angled from the first axis 101, by an angle of less than 30°, such as on the order of magnitude of 5°. Thus, the coil of the coil spring 15 defines an acute angle with a respective plane normal to the centerline of the spring 15. A radial cross section of the canted coil spring 15 has an elliptical shape. The protruding portion of the spring 15 is displaceable in a radially outward direction, thereby compressing the spring and causing increased canting, in response to which a reaction force acts in a radially inward direction.

The groove 17 in which the canted coil spring 15 is arranged is defined by a pair of spaced apart first and second flanges 19, 21 which extend radially inwardly from the sleeve 7. The first flange 19 is arranged at a forward (F) end of the sleeve 7 and has a distal end which defines an annular abutment surface 23. The abutment surface 23 is parallel to the longitudinal (first) direction and faces radially to the axis 101. The abutment surface 23 is intended for abutting a corresponding surface at 100 of the mating connector 51 for preventing transverse displacement of the connectors 1, 51 with respect to each other when they are in the fully engaged configuration.

The second flange 21 (FIG. 3) has a distal end which defines a frustro-conical surface 102. The frustro-conical surface is intended for longitudinally and transversely locating the connector 1 with respect to the mating connector 51 as the connectors 1, 51 are brought into engagement.

The connector 1 further comprises an electrical contact assembly which is housed within the sleeve 7 of the connector body 5, behind (rearward R of) the second flange 21. The electrical contact assembly comprises an annular seal 25, a dielectric spacing element 27 provided with a plurality of through holes extending in the first direction, and a plurality of fixed elongate conductive solder contacts 29 arranged in respective through holes of the spacing element 27 for providing electrical connections. The annular seal 25 of the contact assembly is maintained in pressure contact with the second flange 21 by a resilient retaining ring 31. The retaining ring is received in a second groove 33 formed in the inner surface of the sleeve 7 and bears against the spacing element 27.

A rearward (R) end of the sleeve 7 is provided with a disc-shaped shielding cap 35 which covers the electrical contact assembly and is attached to the body 5 after the inner conductors of the terminated cable have been soldered to the solder contacts 29. A space between the electrical connection assembly and the shielding cap 35 may be potted with a sealant material for additional protection against ingress of moisture and other contaminants.

The collar portion 37 of the connector body 5 is clearly visible in FIG. 3. As described above the collar portion 37 provides an elongate opening extending in the second direction for routing the inner conductors of the cable. An outer surface of the collar portion 37 defines a crimp barrel 106 for receiving the outer conductor, or braid, of the cable and over which a ferrule 39 is crimped in a conventional manner which will be well understood by the skilled person. The collar portion 37 is provided with the protective boot 13, as illustrated in the Figure, which is maintained in position by engagement with a circumferential flange 41 formed on the outer surface of the collar portion. The collar portion 37, crimp barrel 106, ferrule 39 and boot 13 all form a primarily-rigid tube 108 extending radial to the axis 101 and through which an electrical cable can extend.

Figure 4:
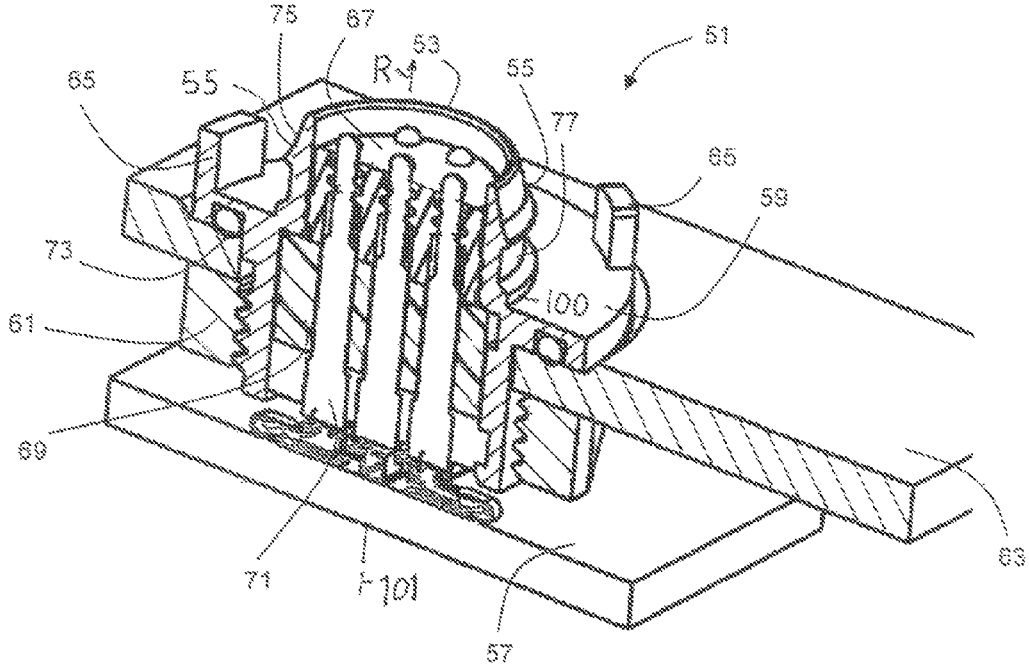
FIG. 4 is a cut-away perspective view showing the connector of FIG. 1*b* in more detail.

FIG. 4 shows the mating connector 51 shown in FIG. 1*b* in greater detail. The Figure shows the connector body 53 and lock nut 61 described hereinabove, together with other features of the connector 51. Thus, the connector further comprises an electrical contact assembly which is housed within the sleeve 55 of the connector body 53. The electrical contact assembly comprises a resilient seal 67, a dielectric spacing element 69 provided with a plurality of through holes, and a plurality of elongate conductive solder contacts 71 arranged in respective through holes of the spacing element 69 for providing electrical connections. The solder contacts 71 may, for example, be soldered directly to the conductive tracks of a printed circuit board 57, as illustrated. The solder contacts 71 are so-called pogo contacts in that they are provided as two parts which can be pressed together against the action of a compression coil spring (not shown) arranged inside the contacts 71, as in U.S. Pat. No. 7,597,588. The use of such sprung contacts ensures a firm pressure engagement between the contacts 29, 71 of the two connectors 1, 51 when the connectors 1, 51 are in the mated configuration.

The mounting flange 59 (FIG. 4) of the mating connector 51 is provided with a groove in its surface which faces the mounting panel 63. A resilient sealing member, such as a rubber "O" ring at 73 is received in the groove for preventing ingress of moisture and other contaminants between the connector 51 and the panel 63.

An outer surface of the sleeve 55 of the connector body 53 is profiled to define a cam surface for bearing against the canted coil spring 15 of the angled connector 1 when the connectors 1, 51 are brought into engagement with each other. In particular, a forward end of the outer surface of the sleeve 55 is provided with a substantially frustro-conical (tapered) surface 75 (FIG. 4) having a diameter which gradually increases in a forward direction away from a leading edge of the sleeve 55. The frustro-conical surface 75 leads into a circumferential groove 77 which is arranged for receiving the canted coil spring 15 when the connectors 1, 51 are in the mated configuration. The frustro-conical surface 75 serves two purposes: firstly, it progressively bears against and displaces the canted coil spring 15 when the connectors 1, 51 are brought into engagement, as mentioned above, so that the coil spring 15 is able to compress and then snap into the groove 77. Secondly, it may cooperate with the corresponding frustro-conical surface of the angled connector 1 to longitudinally and transversely locate the connectors 1, 51 with respect to each other as they are brought into engagement.

A portion of the outer surface of the sleeve 55 of the connector body 53 adjacent to the mounting flange 59 is provided with an annular abutment surface 100 (FIG. 4). The abutment surface 100 faces away from the connector axis and is intended for abutting the corresponding surface 23 (FIG. 3) of the angled connector 1 for preventing transverse displacement of the connectors 1, 51 with respect to each other when they are in the fully engaged configuration.

Figure 5:
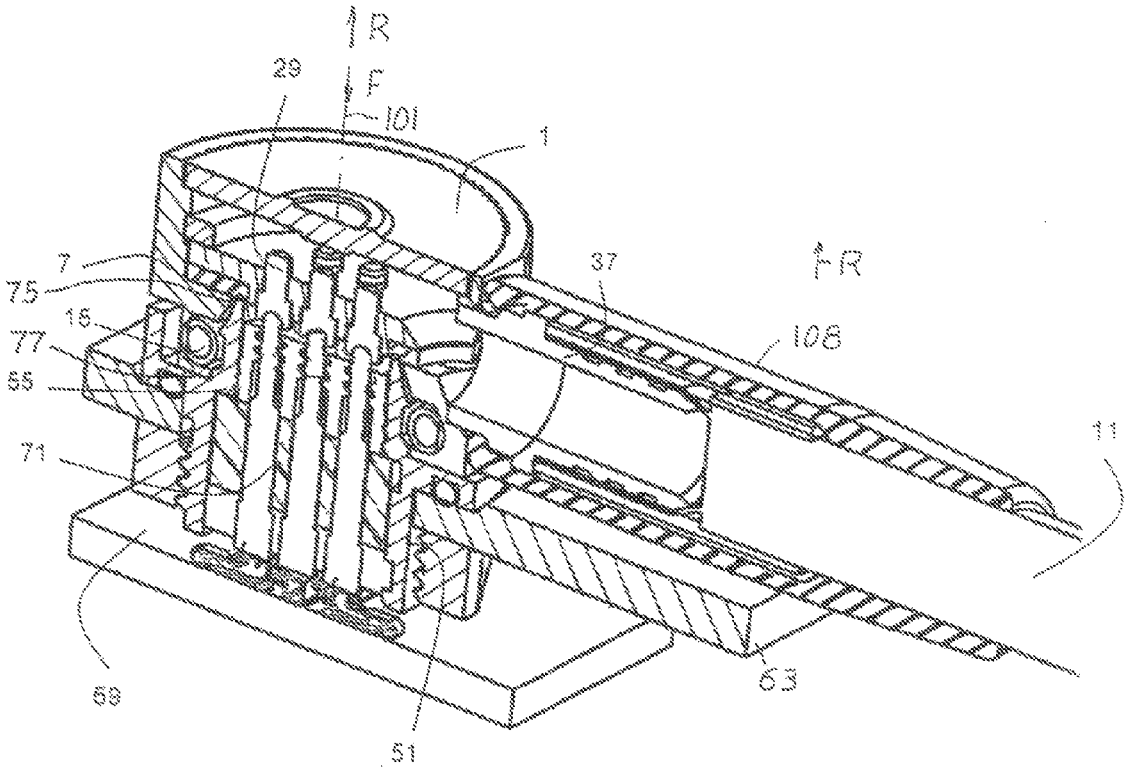
FIG. 5 is a cut-away perspective view showing the connectors of FIGS. 1*a* and 1*b* in the mated configuration in more detail.
Figure 6:
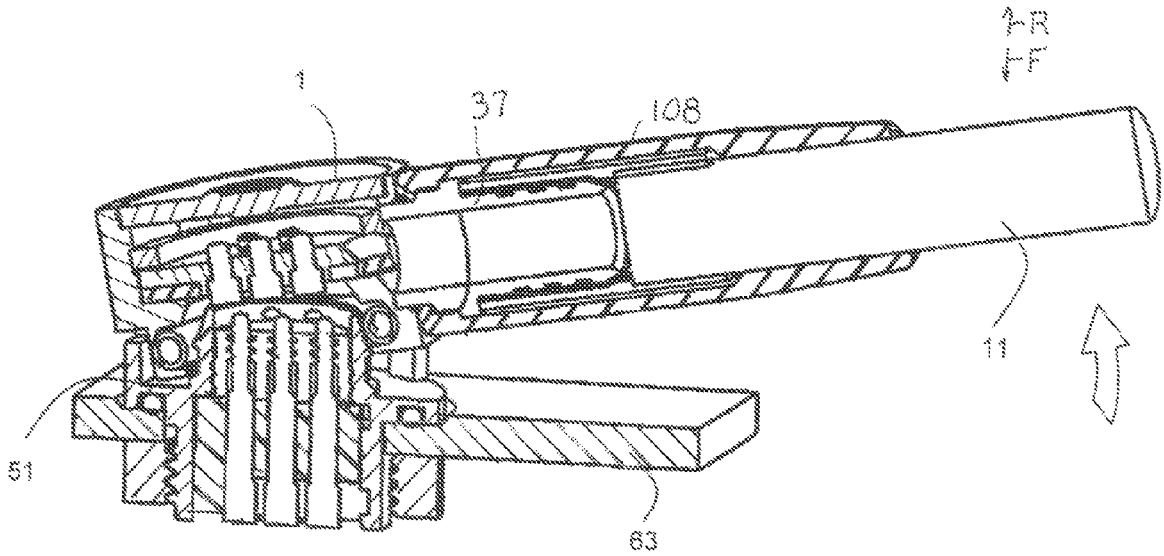
FIG. 6 is a cut-away perspective view similar to that of FIG. 5 but showing the connectors being disengaged.

Use of the angled connector 1 and mating connector 51 described hereinabove will now be described with reference to FIG. 5, which shows the connectors 1, 51 of FIGS. 1*a* and 1*b* in the mated configuration, and FIG. 6, which shows the connectors 1, 51 being disengaged.

The angled connector 1 is used to terminate a shielded electrical cable 11. In particular, the inner conductors of the cable 11 are routed through the collar portion 37 of the connector body 5 and soldered to the contacts 29. The outer conductor braid of the cable 11 is received over the collar portion 37 and a ferrule 39 (FIG. 3) is crimped thereover in a conventional manner. The protective rubber boot 13 is then installed over the ferrule 39. The ferrule 39, boot 13, collar and crimp sleeve 106 form a tube 108 that forms the passageway 112 along which the cable 11 extends.

The mating connector 51 is mounted in a panel 63 (FIG. 4) using the lock nut 61. The contacts 71 of the mating connector 51 are then soldered directly to the conductive tracks of a printed circuit board 57.

The connectors 1, 51 are engaged by roughly aligning them transversely (perpendicular to axis 101) and then bringing them towards each other in the longitudinal (first) direction 101. As the connectors 1, 51 come into contact with each other, the frustro-conical (tapered) surface 75 of the sleeve 55 of the mating connector 51 bears against, and gradually compresses, the canted coil spring 15 of the first connector 1 in a radial outward direction. Continued engagement of the connectors 1, 51 then causes the canted coil spring 15 to slide beyond the frustro-conical (tapered) surface 75 and snap into the groove 77 in the outer surface of the sleeve 55. In this fully engaged configuration, the connectors 1, 51 are protected against accidental disengagement by the canted coil spring, which resists axial separation of the connectors 1, 51.

Furthermore, in the fully engaged configuration, the abutment surfaces 23, 100 of the connectors 1, 51 face each other. Consequently, any tension on the cable 11 results in the abutment surfaces 23, 79 engaging each other to prevent distortion of the canted coils spring 15 and possible disengagement of the connectors 1, 51.

In the fully engaged configuration of the connectors 1, 51, the canted coil spring 15 bears against the bodies 5, 53 of both connectors 1, 51 to provide a reliable electrical connection therebetween. In this way, a reliable ground path may be provided from the outer conductor of the terminated cable to a ground pin of the mating connector 51.

The connectors 1, 51 are disengaged by separating them in a substantially longitudinal direction (along axis 101), against the action of the canted coil spring 15. Sufficient force for disengaging the connectors 1, 51 can be applied by inserting the user's hand between the panel 63 (FIG. 5) and the tube 108 such as the collar portion 37 of the tube. The tube 108 is moved rearward R at a location spaced from the axis 101 to pivot the angled connector 1, as illustrated in FIG. 6.

Compared to the known connector arrangement disclosed in U.S. Pat. No. 2,761,111, the connector arrangement of the invention described above can be provided with a relatively high disengagement force, since the pivoting of the collar portion 37 provides mechanical advantage. Furthermore, tension on the terminated cable 11 cannot cause accidental disengagement of the connectors 1, 51, since the abutment surfaces 23, 79 are brought into contact to prevent distortion of the canted coil spring 15. A reliable electrical connection between the connector bodies 5, 53 is provided for grounding, since the canted coil spring bears against both bodies.

A specific embodiment of the invention has been described above. Various changes and modifications may be made to the specific embodiment without departing from the invention.

For example, the canted coil spring may be arranged on the mating connector and the cam surface arranged on the angled connector. The canted coil spring could be replaced by a plurality of discrete spring elements spaced about the circumference of either connector.

The novel features of the invention are set forth with particularity in the appended claims. The invention will be best understood from the following description when read in conjunction with the accompanying drawings.

What is claimed is:

1. An electrical connector pair comprising:

a first electrical connector (1) for terminating an electrical cable (11) and for engaging with a second electrical connector (51), the first connector comprising a body (5) having an engagement portion including a first sleeve (7) of predetermined width which extends about a first axis (101), for surrounding and engaging the second electrical connector, the body further having a passage (112) for routing conductors of the cable away from the connector; and said second electrical connector (51) being mated to the first electrical connector, the second connector comprising a panel (63) lying in a plane that is perpendicular to a second axis (105) and to said first axis (101) with said panel being longer than twice said sleeve width, and a body (53) mounted on said panel and having an engagement portion which includes a second sleeve (55), the second sleeve extending about said second axis (105) and being engaged with the first sleeve (7) of the first connector, the second sleeve projecting from said panel;

wherein the first connector (1) further comprises at least one resilient single-turn coil spring (15) arranged on said first sleeve, the coil spring being capable of deforming in a second direction (103) that is radial to said first axis (101) and providing a reaction force for maintaining the engagement of the second connector with the first connector;

and wherein said first connector includes a tube (108) positioned to route the conductors of the cable away from the connector in a direction which is primarily perpendicular to the first direction, said tube having a portion spaced from said axis which is unrestricted against movement in a direction (R) away from said second connector to pry said connectors apart in a pivotal manner;

said tube (108) having a length in said second direction (103) that is a plurality of times as great as the width of said first sleeve (7), so the connectors can be disengaged by inserting the user's hand between the panel (63) and the tube.

* * * * *